United States Patent [19]

Morino et al.

[11] Patent Number: 4,892,080

[45] Date of Patent: Jan. 9, 1990

[54] IGNITION SYSTEM FOR INTERNAL COMBUSTION ENGINE

[75] Inventors: Seiji Morino, Okazaki; Satoru Kawamoto, Anjo; Yoshihiro Yoshitani, Nagoya; Toshio Sugimoto, Okazaki; Toshio Nariki, Kariya, all of Japan

[73] Assignee: Nippondenso Co., Ltd., Kariya, Japan

[21] Appl. No.: 214,443

[22] Filed: Jul. 1, 1988

[30] Foreign Application Priority Data

Jul. 3, 1987 [JP] Japan ..... 62-167419
Nov. 30, 1987 [JP] Japan ..... 62-302968

[51] Int. Cl.[4] ..... F02P 3/06
[52] U.S. Cl. ..... 123/604; 123/605
[58] Field of Search ..... 123/604, 606, 620, 637; 315/209 T, 209 CD, 223, 224

[56] References Cited

U.S. PATENT DOCUMENTS

| | | | |
|---|---|---|---|
| 3,280,809 | 10/1966 | Issler | 123/604 |
| 3,800,771 | 4/1974 | Mackie | 123/604 |
| 3,906,919 | 9/1975 | Asik et al. | 123/604 |
| 4,046,125 | 9/1977 | Mackie | 123/604 |
| 4,223,656 | 9/1980 | Hamley | 123/604 |
| 4,245,609 | 6/1981 | Gerry | 123/604 |
| 4,326,493 | 4/1982 | Merrick | 123/604 |
| 4,345,576 | 8/1982 | Moseley et al. | 123/604 |
| 4,537,174 | 8/1985 | Nagasawa | 123/604 |
| 4,699,115 | 10/1987 | Terada et al. | 123/604 |

FOREIGN PATENT DOCUMENTS

| | | | |
|---|---|---|---|
| 4412804 | 6/1969 | Japan | 123/604 |
| 5598671 | 7/1980 | Japan | 123/604 |

*Primary Examiner*—Raymond A. Neill
*Attorney, Agent, or Firm*—Cushman, Darby & Cushman

[57] ABSTRACT

A high-energy ignition system for an internal combustion engine in which both magnetic and electrical energy stored in an energy storage coil and in a capacitor are supplied to the primary winding of an ignition coil at a predetermined timing. When a first or second switching device is turned off, the capacitor is charged with the energy stored in advance in the energy storage coil, and upon subsequent turning on of the first switching device, energy is stored in the energy storage coil from a DC power supply. At substantially the same time as the turning off of the first switching device at an ignition timing, the second switching device is turned on to supply the primary winding with the energy stored in the energy storage coil and the capacitor. Alternatively, the capacitor is charged with the energy stored in advance in the energy storage coil through the primary winding of the ignition coil and a charging diode at the time of turning off of the second switching device. The first and second switching devices operate similarly to supply the primary winding through a discharging diode with the energy stored in the energy storage coil and the capacitor.

25 Claims, 14 Drawing Sheets

ASSUME THAT $\tau_5 < \tau_6 + \tau_4$

IGNITION SYSTEM FOR INTERNAL COMBUSTION ENGINE

BACKGROUND OF THE INVENTION

The present invention relates to an ignition system of capacitor discharge type for the internal combustion engine in which the time of spark discharge is lengthened.

In order to prevent the after-glow or smolder of ignition plugs and to improve the ignition performance thereof, a rapid rise of the spark discharge current and a long discharge time are required. Various combinations of the ignition circuits of capacitor discharge type and current interruption type have conventionally been suggested in an attempt to meet these two requirements. (See U.S. Pat. No. 3,280,809)

The conventional ignition systems of these types, however, require a specific inherent DC-DC converter as an ignition system of the capacitive discharge type, for charging a capacitor at high voltage on the one hand and an ignition coil of a large size to store magnetic energy for interrupting the current in the case of the ignition system of current interruption type on the other, thus complicating and making bulky the general construction of the system. This problem becomes especially serious in the case of a cylinder-by-cylinder ignition system with a plurality of ignition coils corresponding to respective cylinders.

SUMMARY OF THE INVENTION

The object of the present invention is to eliminate the need of such a specific DC-DC converter and to provide an ignition system of capacitor discharge type simple in construction, comparatively small in size and having a rapid rise of the spark discharge current with a lengthened discharge time.

According to one aspect of the invention, there is provided an ignition system for the internal combustion engine, comprising a first series closed circuit including a DC power supply, an energy storage coil and a first switching device; a second series closed circuit including the energy storage coil, a diode, the primary winding of the ignition coil and a second switching device; and switching device control means for turning on the first or second switching device to store energy in the energy storage coil, the switching device being then turned off to charge the capacitor by the energy stored in the energy storage coil, the first switching device being turned on after the capacitor is charged to store energy in the energy storage coil from the DC power supply, the second switching device being then turned on substantially simultaneously with the interruption of the first switching device at an ignition timing thereby to supply the primary winding of the ignition coil with the energy stored in the energy storage coil and the energy charged in the capacitor.

According to another aspect of the invention, there is provided an ignition system for the internal combustion engine, comprising a first series closed circuit including a DC power supply, an energy storage coil and a first switching device; a second series closed circuit including the energy storage coil, a first diode, the primary winding of the ignition coil and a second switching device; a series circuit including a second diode in parallel with the second switching device and a capacitor, a third series closed circuit including the primary winding of the ignition coil, the second switching device, the above-mentioned capacitor and a third diode; and switching device control means for charging the capacitor from a series circuit including the energy storage coil and the primary winding of the ignition coil at the time of interrupting the second switching device, the first switching device being then turned on to store energy in the energy storage coil from a DC power supply, the second switching device being then turned on substantially simultaneously with the interruption of the first switching device at an ignition timing thereby to supply the primary winding of the ignition coil with the energy stored in the energy storage coil and the energy charged in the capacitor.

When the first or second switching device is turned off, the capacitor is charged with the energy stored in advance in the energy storage coil, followed by the turning on of the first switching device to store energy in the energy storage coil from the DC power supply. At a subsequent ignition timing, the second switching device is turned on substantially at the same time as the turning off of the first switching device, with the result that the energy stored in the energy storage coil and the energy charged in the capacitor are supplied to the primary winding of the ignition coil.

When the second switching device is turned off, on the other hand, the capacitor is charged with the energy stored in the energy storage coil through the primary winding of the ignition coil and the second diode, followed by the turning on of the first switching device to store energy in the energy storage coil from the DC power supply. At a subsequent ignition timing, the second switching device is turned on at substantially the same time as the turning off of the first switching device, with the result that the energy stored in the energy storage coil and the energy charged in the capacitor are supplied to the primary winding of the ignition coil through the first diode or the third diode.

DESCRIPTION OF THE PREFERRED EMBODIMENTS

Figure 1:
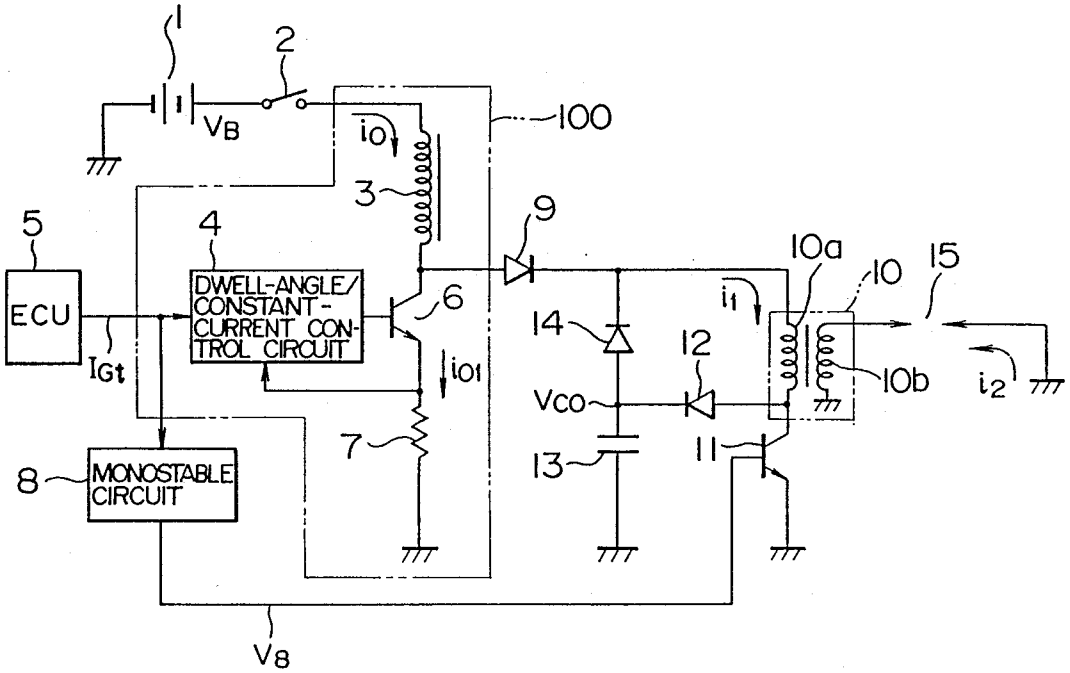
FIG. 1 is a diagram showing an electrical circuit of the system according to a first embodiment of the present invention.

A first embodiment of the present invention will be explained with reference to FIG. 1. The negative side of a battery 1 making up a DC power supply is grounded, and the positive side thereof connected to a terminal of an energy storage coil 3 through a key switch 2. The other terminal of the coil 3 is connected in series to the collector of a power transistor 6 making up a first switching device. The emitter of the power transistor 6 is connected to a current-detection resistor 7. An ignition signal $IG_t$ from a well-known electronic control unit (ECU) 5 is applied to a well-known dwell-angle/-constant-current control circuit 4 which controls by feedback the current flowing time (dwell angle) and the value of a current $i_{01}$ in accordance with the detection by the current-detecting resistor 7. The output of the dwell-angle/constant-current control circuit 4 is connected to the base of the power transistor 6. An energy storage circuit 100 including parts designated by 3, 4, 6 and 7, has an energy storage coil 3 without the secondary winding of an ignition coil of an ordinary ignition system of current interruption type, and the other component parts remain the same as in the conventional configurations. The output of the energy storage circuit 100 is taken out from the collector of the power transistor 6 and is connected through a first forward-connected diode 9 to a terminal of the primary coil 10*a* of the ignition coil 10. The other terminal of the primary winding 10*a* of the ignition coil 10 is connected to the collector of a power transistor 11 making up a second switching device, the emitter of the power transistor 11 being grounded. The collector of the power transistor 11 is connected through a second diode 12 in the forward direction thereof, which diode 12 has the cathode connected to a terminal of the capacitor 13 and the anode of the diode 14 at the same time. The other terminal of the capacitor 13 is grounded, and the cathode of a third diode 14 is connected to the cathode of the first diode 9, that is, the terminal of the primary winding 10*a* of the ignition coil 10. A terminal of the secondary winding 10*b* of the ignition coil 10 is grounded, and the other terminal of the secondary winding 10*b* connected to the ignition plug 15.

The ignition signal $IG_t$ from the ECU 5 is also applied to a monostable circuit 8 for generating a high-level output $V_8$ of a predetermined time $\tau$ (about 2 ms) with the fall of the ignition signal $IG_t$ from high to low level, and the output of the monostable 8 is connected to the base of the power transistor 11. A compact closed magnetic loop coil without any air gap in a closed magnetic loop can be used arbitrarily as the ignition coil 10.

Figure 2:
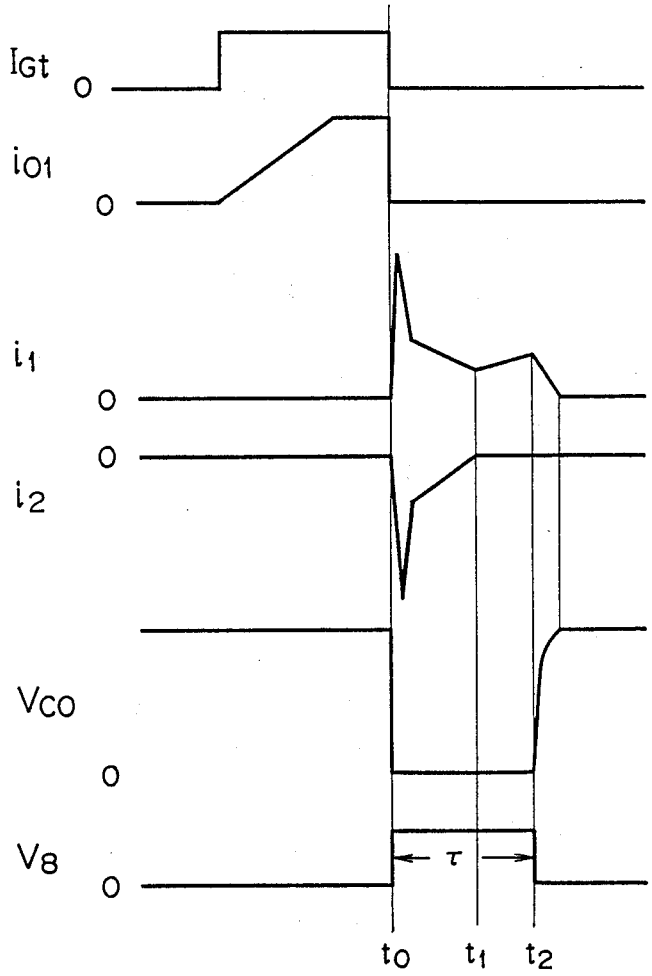
FIG. 2 shows waveforms produced at various parts for explaining the operation of the system shown in FIG. 1.

Waveforms produced at various parts of the system of FIG. 1 are shown in FIG. 2.

Now, the operation of the system having the aforementioned configuration will be explained. The energy storage circuit 100, which operates exactly the same way as an ordinary ignition system of current interruption type, will not be described in detail. In accordance with the ignition signal $IG_t$ from the ECU 5, the power transistor 6 is turned on and begins to conduct, a current $i_{01}$ begins to flow in the energy storage coil 3 thereby to store energy in the coil 3. When this current $i_{01}$ reaches a predetermined value, the dwell-angle/constant-current control circuit 4 operates the power transistor 6 in an unsaturated region thereby limiting this current $i_{01}$ to this predetermined value. After that, at a time point $t_0$ defining an ignition timing, the ignition signal $IG_t$ is reduced to a low level, whereby the power transistor 6 is turned off suddenly. At the same time, monostable circuit 8 is actuated, and the power transistor 11 is turned on for a predetermined length of time $\tau$ by the output $V_8$ of the monostable circuit 8. This causes energy stored in the energy storage coil 3 to be supplied to the ignition coil 10, which is thus actuated to start spark discharge of the ignition plug 15 at this time point $t_0$. The current stored in the energy storage coil 3 is reduced by discharge, and the discharge current of the ignition plug 15 ceases at the time point $t_1$ when the reducing current value of the coil 3 coincides with the current value required for full storage of magnetic energy in the ignition coil. If the transistor 11 is further kept in an on state, current flows from the battery 1 to store magnetic energy in the energy storage coil 3 and the primary winding 10*a* of the ignition coil 10.

At a subsequent time point $t_2$ when the output voltage $V_8$ of the monostable circuit 8 takes a low level, the power transistor 11 is turned off, so that the capacitor 13 is charged as shown by $V_{CO}$ in FIG. 2 by the magnetic energy stored in the energy storage coil 3 through the second diode 12 and the primary winding 10*a* of the ignition coil 10. With the turning off of the transistor 11, the primary current of the ignition coil 10 returns and attenuates through the diodes 12 and 14. Therefore, even when the transistor 11 is turned off outside of a normal ignition timing period, a useless high voltage would not be generated across the secondary winding of the ignition coil 10.

Now, upon application of the ignition signal $IG_t$ from the ECU 5, the power transistor 6 turns on, and the current $i_{01}$ again flows again through the energy storage coil 3, to therein store magnetic energy. With the arrival of an ignition timing when the current of the energy storage coil 3 reaches a predetermined value, the power transistor 6 is turned off suddenly. If the power transistor 11 is turned on at the same time, the current $i_1$ flows through the primary coil 10*a* resulting in the combination of the stored energy of the capacitor 13 and that of the energy storage coil 3 being primary coil 10*a* of the ignition coil 10, thereby producing a secondary discharge waveform $i_2$ with a rapid rise and a comparatively long discharge period. Like process is subsequently repeated.

Figure 3:
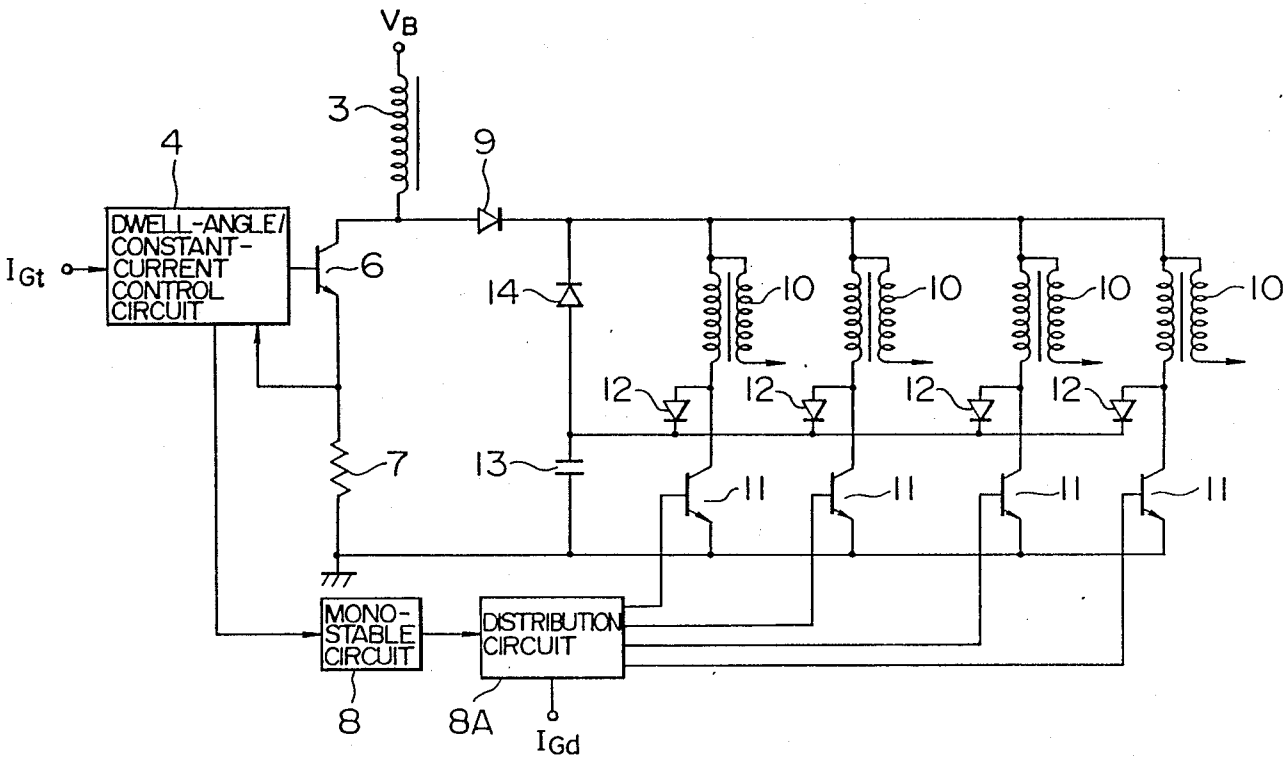
FIGS. 3, 4 and 6 are diagrams showing electrical circuits of the essential parts of second to fourth embodiments of the present invention respectively.

FIG. 3 shows a second embodiment of the invention applied to a cylinder-by-cylinder ignition system of a four-cylinder engine. This ignition system comprises a plurality of ignition coils 10, power transistors 11 and second diodes 12 corresponding to respective cylinders, while each of the other circuit parts is shared by a plurality of cylinders. The configuration of this system is thus greatly simplified as compared with when a plurality of energy storage circuits 100 are provided for respective cylinders. In FIG. 3, numeral 8A designates a well-known distribution circuit for distributing the output of the monostable circuit 8 among the power transistors of the cylinders sequentially in response to an ignition distribution signal $IG_d$.

Figure 4:
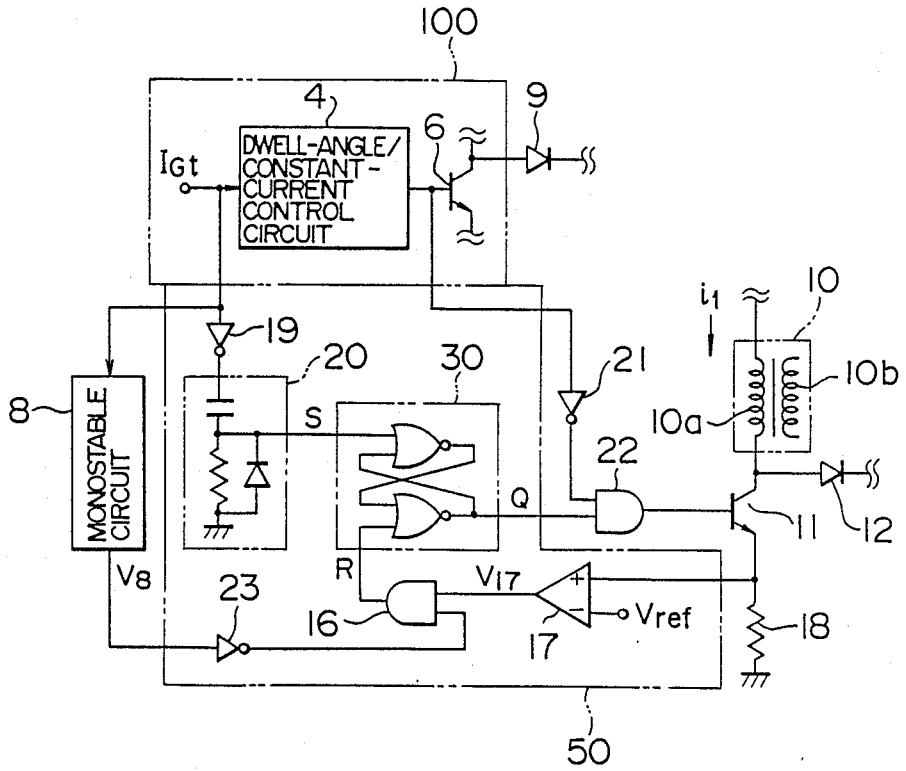

FIG. 4 shows a configuration of the essential parts (the parts different from those in the embodiment of FIG. 1) according to a third embodiment of the present invention. Unlike in the embodiment of FIG. 1 where the power transistor 11 is controlled by the output $V_8$ of the monostable circuit 8, the embodiment of FIG. 4 comprises a constant-current control circuit 50 for turning off the power transistor 11 when the current flowing in the power transistor 11 reaches a predetermined value. The ignition signal $IG_t$ is applied to the monostable multivibrator circuit 8 on the one hand and to a differentiation circuit 20 through an inverter 19 on the other hand. The output of the differentiation circuit 20 is connected to the S input of a flip-flop 30. The emitter of the power transistor 11 is grounded through a resistor 18 on the one hand and connected to the positive input of a comparator 17 at the same time. The negative input of the comparator 17 is connected to a reference voltage $V_{ref}$. The output of the comparator 17 is connected to an input terminal of an AND gate 16, the other input of which is connected with the output of the monostable circuit 8 through an inverter 23. The output of the AND gate 16 is connected to the R input of the flip-flop 30, the output Q of which is connected to an input terminal of an AND gate 22. The output of the dwell angle control circuit 4 is connected through the inverter 21 to the other input terminal of the AND gate 22, the output of which is connected to the base of the power transistor 11.

Figure 5:
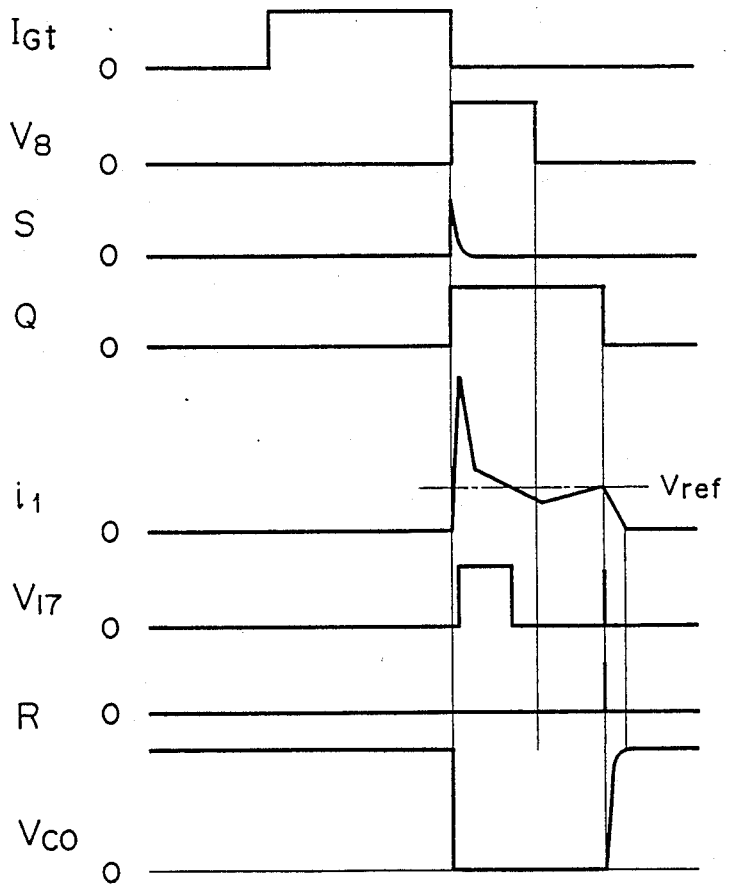
FIG. 5 shows waveforms produced at various parts for explaining the operation of the system shown in FIG. 4.

Now, the operation of the circuit configured as above will be explained with reference to the waveform diagram of FIG. 5. At the fall of the pulse of the ignition signal $IG_t$, a short pulse S is produced from the differentiation circuit 20 through the inverter 19, and with the arrival of this short pulse S at the S input of the flip-flop 30, the output Q of the flip-flop 30 rises to high level, and the current $i_1$ flows through the primary winding 10*a* of the ignition coil 10 by turning-on of the power transistor 11. In view of the fact that the output Q of the flip-flop 30 is connected through an AND gate 22, however, the power transistor 11 is capable of being turned on within the low level range of the output of the dwell angle control circuit 4. When the current of the power transistor 11 reaches a predetermined value, the output $V_{17}$ of the comparator 17 rises to high level, which output signal is applied via an AND gate 16 to the R input of the flip-flop 30. The output Q of the flip-flop 30 is thus reduced to low level, thereby turning off the power transistor 11. The output $V_{17}$ of the comparator 17 rises to high level after the fall of the pulse of the ignition signal $IG_t$, and therefore the output $V_8$ of the monostable circuit 8 is kept at high level for about 1 ms from the fall of the ignition signal $IG_t$. While the output $V_8$ of the monostable circuit 8 remains high, the output of the comparator 17 is prohibited from passing through the AND gate 16 by the inverter 23, so that a signal shown by R in FIG. 5 is applied to the R input of the flip-flop 30. It is thus possible to detect the current flowing in the series circuit including the energy storage coil 3 and the primary winding 10*a* of the ignition coil 10 without substantially detecting the large current due to the capacitor energy immediately after start current of all the currents flowing through the primary winding 10*a* of the ignition coil 10.

Figure 6:
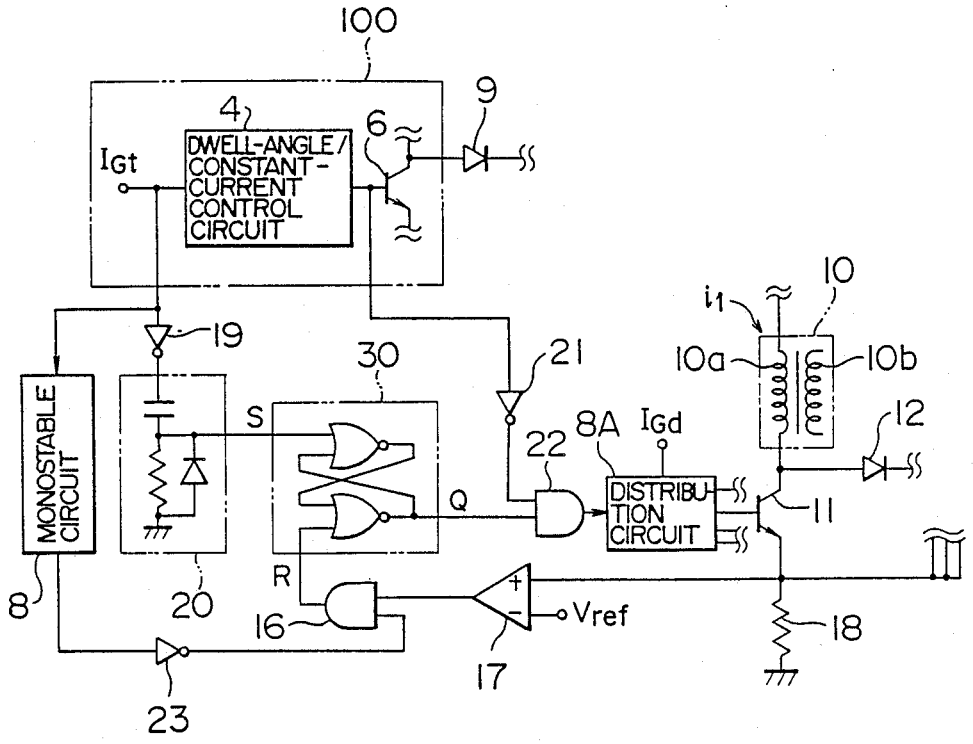

FIG. 6 shows a configuration of the essential parts of a fourth embodiment of the invention in which the system shown in FIG. 4 is applied to a cylinder-by-cylinder ignition system of a four-cylinder engine. The output of the AND gate 22 is connected through the distribution circuit 8A to the base of each power transistor 11 corresponding to each cylinder, and the emitters of the power transistors for the respective cylinders to a terminal of a resistor 18 in common.

Figure 7:
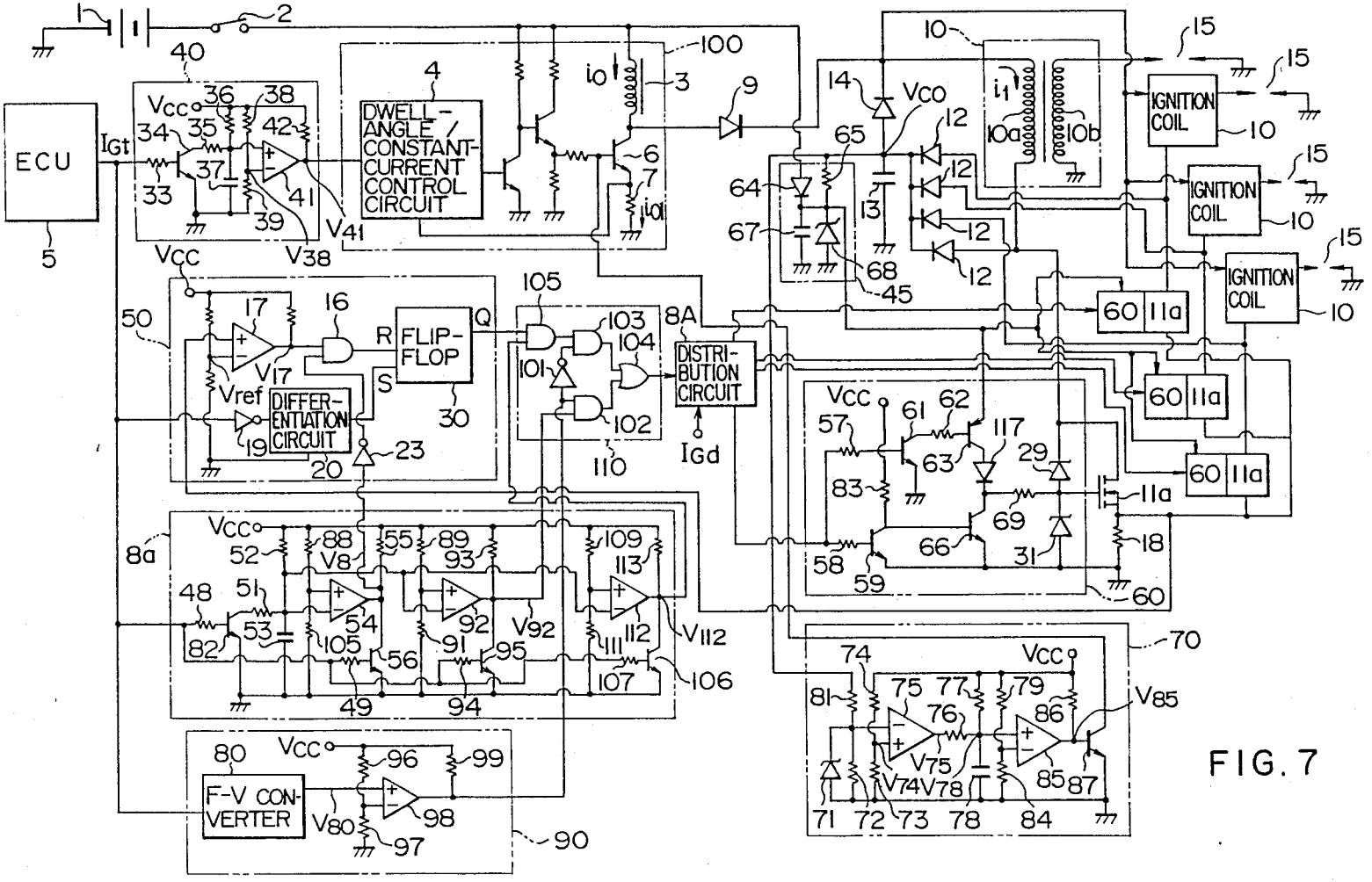
FIGS. 7 and 11 are diagrams showing electrical circuits according to fifth and sixth embodiments of the present invention respectively.
Figure 8:
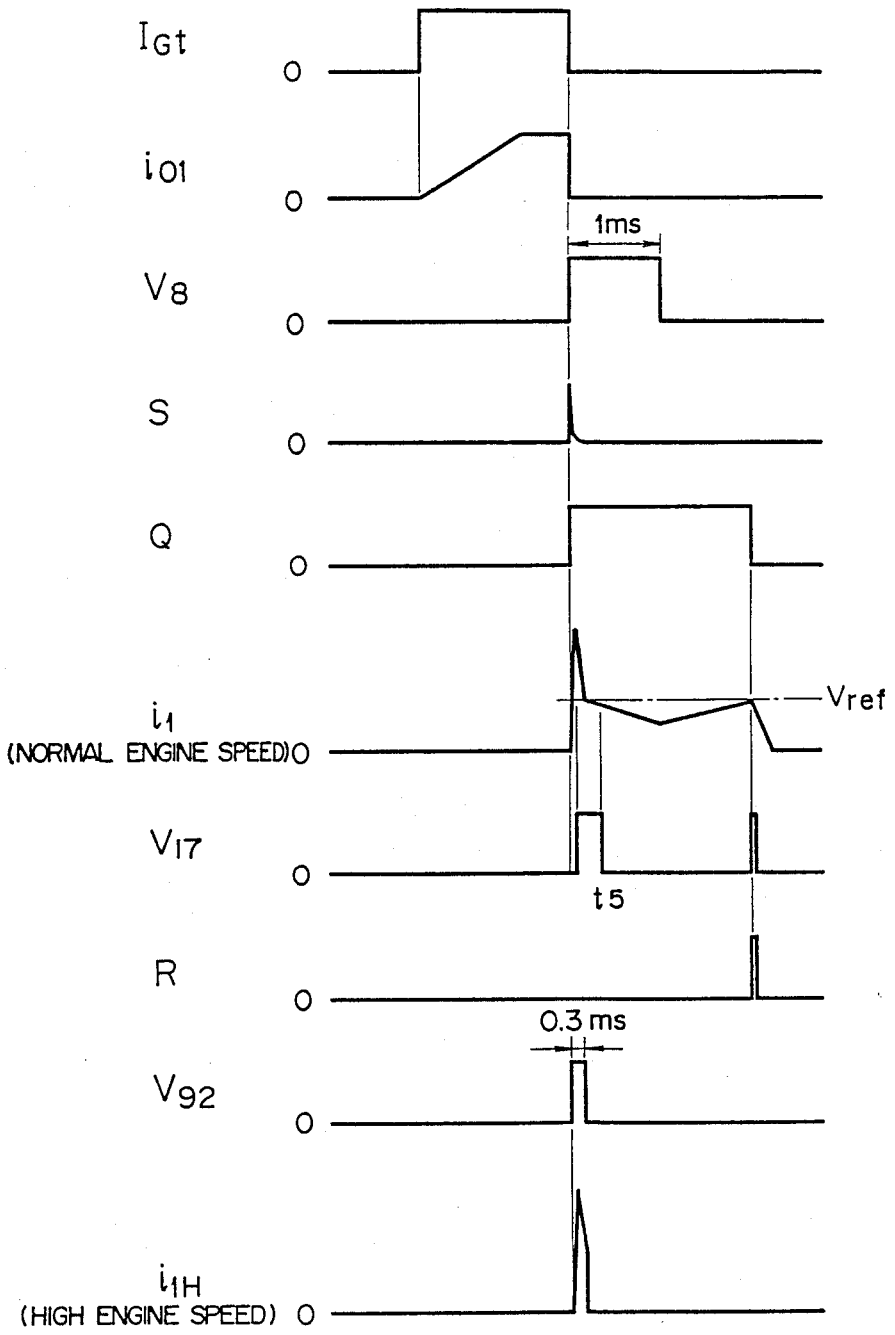
FIGS. 8 to 10 are diagrams showing waveforms produced at various parts for explaining the system shown in FIG. 7.
Figure 9:
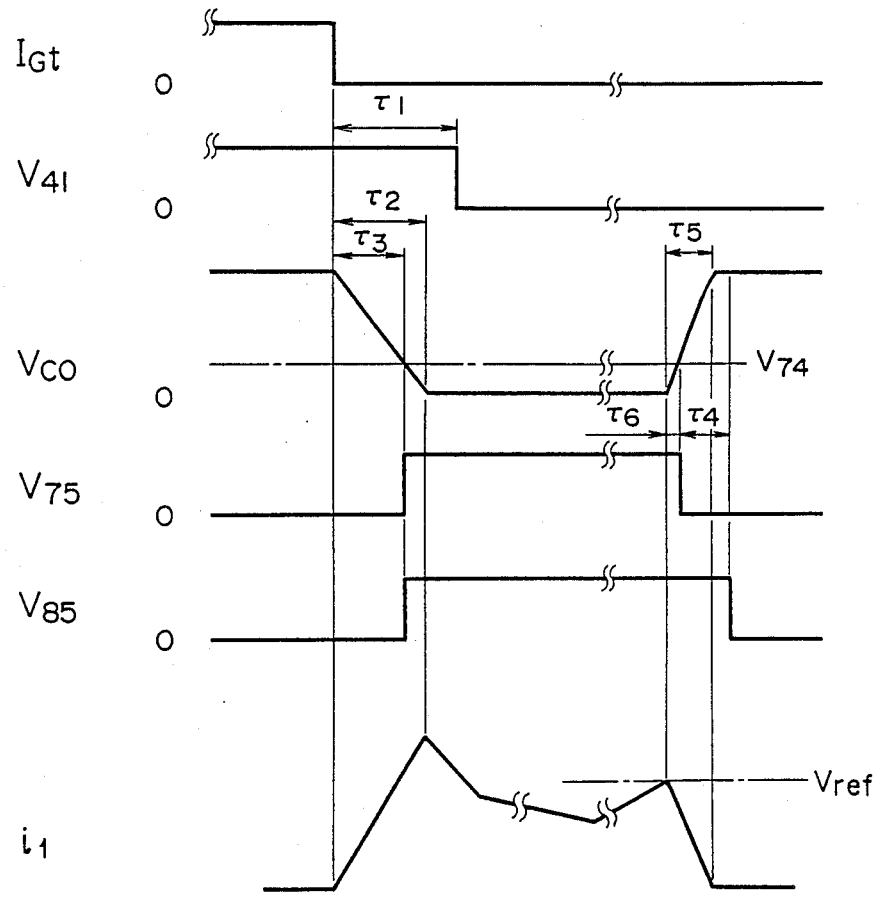
Figure 10:
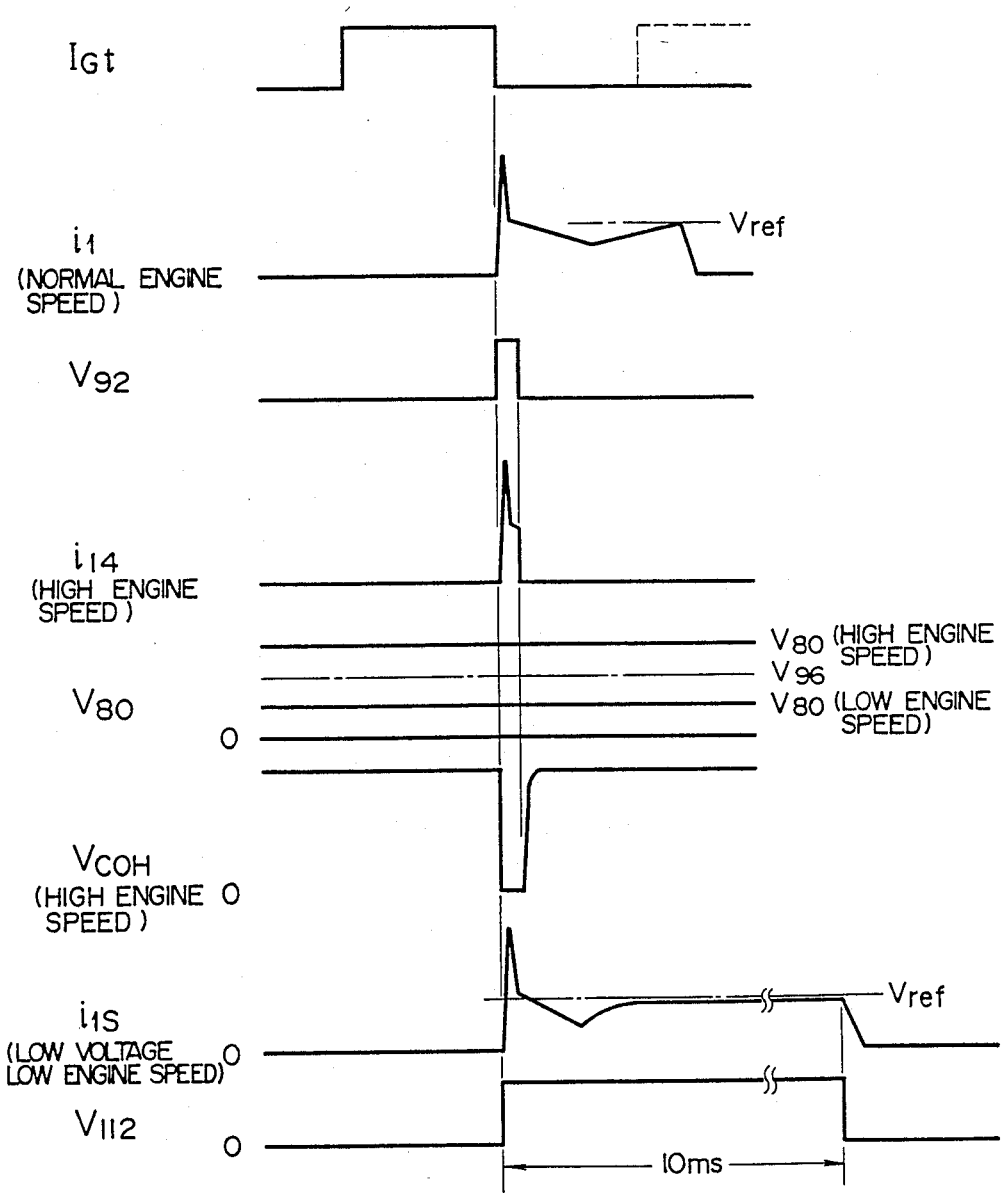

FIG. 7 shows a fifth embodiment of the system according to the present invention, and FIGS. 8 to 10 waveforms produced at various parts for explaining the operation of the system shown in FIG. 7. The configuration of the fifth embodiment is different from those of the first to third embodiments in the following:

(a) A delay circuit 40 is inserted between the ECU 5 and the dwell-angle/constant-current control circuit 4.

(b) The monostable circuit 8 for generating a single monostable output is replaced by a monostable circuit 8*a* for generating three monostable outputs $V_8$, $V_{92}$ and $V_{112}$.

(c) An engine speed detection circuit 90 and an arc time switching circuit 110 are added.

(d) A MOS field effect transistor (hereinafter referred to merely as MOSFET) 11*a* is used as a second switching device.

(e) A power circuit 45 and a drive circuit 60 are added for driving the MOSFET 11*a*.

(f) A capacitor-voltage detection delay/simultaneous-current-flow preventing circuit 70 is added. Now, the configuration of each circuit will be explained in detail.

First, reference is made to the configuration of the delay circuit 40. The $IG_t$ signal of the ECU 5 is connected to the base of the transistor 34 through the resistor 33, the emitter of the transistor 34 is grounded, and the collector thereof is connected to the positive input terminal of the comparator 41 through the resistor 35. The positive input terminal of the comparator 41 is grounded through the capacitor 37 on the one hand and connected to a 5 V power supply ($V_{cc}$) through the resistor 36 at the same time. Further, the negative input terminal of the comparator 41 is grounded via the resistor 39 on the one hand, and connected to $V_{cc}$ through the resistor 38 on the other. The output terminal of the comparator 41 is connected to $V_{cc}$ through the resistor 42. The output signal of the comparator 41 is applied to the dwell angle/constant-current control circuit 4.

Now, the configuration of the monostable circuit 8*a* will be explained. The $IG_t$ signal is connected through a resistor 48 to the base of a transistor 82, the emitter of which is grounded. The collector of the transistor 82 is connected to the negative input terminal of a comparator 54 through a resistor 51. The negative input terminal of the comparator 54 is connected through a capacitor 53 to the earth while at the same time being connected through a resistor 52 to $V_{cc}$. The positive input terminal of the comparator 54 is grounded through a resistor 105 on the one hand and is connected through a resistor 88 to $V_{cc}$ at the same time. The output terminal of the comparator 54 is connected to $V_{cc}$ through a resistor 55 and also to the collector of a transistor 56, the emitter of which is grounded and the base thereof connected to the $IG_t$ signal through a resistor 49. Further, the output terminal of the comparator 54 is connected to the inverter 23.

The negative input terminal of a comparator 92 is connected to the negative input terminal of a comparator 54, and the positive input terminal of the comparator 92 grounded through a resistor 91 on the other hand while being connected to $V_{cc}$ through a resistor 89 at the same time. The output terminal of the comparator 92 is connected via $V_{cc}$ to a resistor 93 and to the collector of a transistor 95 at the same time. The emitter of this transistor 95 is grounded, and the base thereof connected to the $IG_t$ signal through a resistor 94. The output terminal of the comparator 92 is connected to an input terminal of an AND gate 102.

The negative input terminal of the comparator 112 is connected to the negative input terminal of a comparator 54, and the positive input terminal of the comparator 112 is grounded via a resistor 111 on the one hand and connected to $V_{cc}$ through a resistor 109 at the same time. The output terminal of the comparator 112 is connected via a resistor 113 to $V_{cc}$, while at the same time being connected to the collector of the transistor 106, the emitter of which is grounded. The base of the transistor 106 is connected through a resistor 107 to the $IG_f$ signal, and the output terminal of the comparator 112 to an input terminal of an AND gate 105.

The configuration of the engine speed detection circuit 90 will be explained. The $IG_f$ signal is connected to the input terminal of a well-known F-V converter 80 for producing a voltage proportional to the frequency of the $IG_f$ signal. The output terminal of the F-V converter 80 is connected to the positive input terminal of a comparator 98, the negative terminal of which is grounded via a resistor 97 on the one hand and connected to $V_{cc}$ through a resistor 96 on the other. The output terminal of the comparator 98 is connected through a resistor 99 to $V_{cc}$ on the one hand and to the other input terminal of the AND gate 102 at the same time. The output terminal of the comparator 98 is also connected to an input terminal of the AND gate 103 via the inverter 101.

Now, the configuration of the arc time switching circuit 110 will be explained. The output of the AND gate 102 is connected to an input terminal of an 0R gate 104, and the other terminal of the AND gate 103 to the output terminal of the AND gate 105, the other input terminal of which is connected to an output terminal Q of the flip-flop 30. The output terminal of the AND gate 103 is connected to the other input terminal of the 0R gate 104, the output terminal of which is connected through the distribution circuit 8A to the drive circuits 60 of the respective cylinders distributively.

Now, the configuration of the power circuit 45 and the drive circuit 60 will be explained. The output terminal of the distribution circuit 8A is connected through the resistor 58 to the base of a transistor 59, the emitter of which is grounded on the one hand and connected through a resistor 83 to $V_{cc}$ on the other. The collector of the transistor 59 is connected to the base of a transistor 66, the emitter of which is grounded on the one hand and is connected through a resistor 69 to the gate of the MOSFET **11*a* at the same time. The output terminal of the distribution circuit 8A is connected to the base of a transistor 61 through the resistor 57, and the emitter of the transistor 61 is grounded while being connected through the resistor 62 to the base of a PNP transistor 63. The emitter of this PNP transistor 63 is connected to a terminal of the capacitor 13 through the resistor 65, and the emitter thereof to the cathode of a diode 64, the anode of which is connected through the key switch 2 to the positive terminal of the DC power supply 1. The emitter of the PNP transistor 63 is connected to a terminal of the capacitor 67 and the cathode of a zener diode 68. The anode of the zener diode 68 and the other terminal of the capacitor 67 are grounded. The collector of the PNP transistor 63 is connected through a diode 117 to the collector of the transistor 66. The gate of the MOSFET 11*a* is connected to the anode of a zener diode 29 and the cathode of a zener diode 31. The cathode of the zener diode 29 is of the zener diode 31 grounded. The source of the MOSFET 11*a* is also grounded through the resistor 18**.

Now, the configuration of the capacitor voltage detection delay/simultaneous current-flow preventing circuit 70 will be explained. A terminal of a capacitor 13 is connected via a resistor 81 to the negative input terminal of a comparator 75, and the negative input terminal of the comparator 75 is in turn grounded through a resistor 72 while at the same time being connected to the cathode of a zener diode 71. The anode of the zener diode 71 is grounded, and the positive input terminal of the comparator 75 is connected to $V_{cc}$ via a resistor 74 on the one hand and grounded through a resistor 73 on the other. The output of the comparator 75 is connected to the positive input terminal of a comparator 85 through a resistor 76. The positive input terminal of the comparator 85 is connected to $V_{cc}$ through a resistor 77, and also to a terminal of a capacitor 78. The other terminal of the capacitor 78 is grounded, and the negative input terminal of the comparator 85 is connected to $V_{cc}$ through a resistor 79 while being grounded through a resistor 84 at the same time. The output terminal of the comparator 85 is connected to the base of a transistor 87 and also to $V_{cc}$ through a resistor 86. The emitter of the transistor 87 is grounded, and the collector thereof is connected to the base of the power transistor 6.

Now, the operation of the fifth embodiment having the above-described configuration will be explained. First, reference is made to the waveforms shown in FIGS. 8 and 10 for explaining the change-over of arc period of time. A monostable circuit **8*a* produces three outputs $V_8$, $V_{92}$ and $V_{112}$ having a different predetermined duration-time width from the fall of the $IG_f$ signal respectively. The output $V_8$ has a pulse width of about 1 ms, the output $V_{92}$ a shorter pulse width of about 0.3 ms, and $V_{112}$ a sufficiently longer pulse width of 10 ms. The operation under normal engine speed will not be explained in detail any more as it was explained wit reference to the third embodiment. The output $V_8$ of the comparator 54 is provided for preventing the detection of the large current due to the capacitor energy immediately after start current of all the primary currents $i_1$, and the output $V_{92}$ of the comparator 92 for determining the arc time during high-speed engine operation. In the engine-speed detection circuit 90, the F-V converter circuit 80 produces an output $V_{80}$ proportional to the engine speed. This voltage is compared with a predetermined value $V_{96}$ at a comparator 98, so that when the engine speed exceeds a predetermined level (say, 3000 rpm), the comparator 98 produces a high-level signal, which is applied to the arc time switching circuit 110 to select the output $V_{92}$ of the comparator 92. In this way, while the engine is running at high speed, a short output $V_{92}$ of the comparator 92 is selected thereby to shorten the arc time of the ignition plug 15, so that as shown by the dashed line in FIG. 10, the rise timing of the next $IG_f$ signal is advanced to lengthen the charging period of the energy storage coil 3. Thus, a higher voltage is generated in the energy storage coil 3 while at the same time shortening the on period of the MOSFET 11*a*, thereby reducing the heat generated in the ignition coil 10 and the MOSFET 11*a*. Also, the MOSFET 11*a* is turned off while a sufficient amount of primary current $i_1$ is flowing due to the energy stored in the energy storage coil 3, and therefore the capacitor 13 is charged to a sufficient voltage shown by $V_{COH}$ in FIG. 10 by the energy stored in the energy storage coil 3** in the process.

In the case where the battery voltage is low with the engine speed low, on the other hand, as shown by $i_{1S}$ in FIG. 10, the primary current $i_1$ of the ignition coil may not reach the predetermined value $V_{ref}$. In such a case, the flip-flop 30 fails to be reset, and therefore the MOSFET 11*a* continues to conduct, thereby giving rise to the possibility of being broken by heat. In the embodiment under consideration, however, the output $V_{112}$ of the comparator 112 of the monostable circuit 8*a* is generated only for 10 ms from the fall of the $IG_t$ signal, followed by the closing of the AND gate 105, so that even when the flip-flop 30 fails to be reset, the MOSFET 11*a* is turned off automatically 10 ms after being turned on, thus preventing the MOSFET 11*a* and the ignition coil 10 from being heated.

In the power circuit 45 and the drive circuit 60, the current flowing in the second switching device in the output stage, as shown by $i_1$ in FIG. 8, is very large (about 30A) due to the energy charged in the capacitor 13 immediately after the start of current flow. For this reason, the configuration using the MOSFET 11*a* is shown. The MOSFET 11*a*, different from a bipolar transistor, is of voltage driven type, and therefore a sufficient current may not be supplied sometimes at the time of starting thereof under a low source voltage. In this embodiment, this inconvenience is avoided by using a capacitor 67 which is charged through a resistor 65 with a comparatively high voltage (about 300 V) charged in the capacitor 13. An excessive high voltage is blocked by the zener diode 68, and a voltage of only about 10 V is applied to the gate of the MOSFET 11*a* even when the source voltage is low (as 6 V) as at the time of starting, thereby making it possible to supply a stable primary coil current $i_1$.

Now, the capacitor-voltage detection delay/simultaneous current-flow preventing circuit 70 will be explained with reference to the waveform diagram of FIG. 9. This circuit has two functions which are realized in a single circuit configuration. One of the functions is to provide a time lag between the off timing of the power transistor 6 and the on timing of the MOSFET 11*a*. By setting the on timing of the MOSFET 11*a* somewhat earlier than the off timing of the power transistor 6, the primary coil current $i_1$ is increased thereby to shorten the energization time of the energy storage coil 3 for charging the capacitor 13. The voltage generated under high engine speeds can thus be maintained at a high level. The other function is to prevent simultaneous occurrences of currents flowing in the power transistor 6 and the MOSFET 11*a*. These two functions are realized by detecting the voltage across the capacitor 13.

First, as shown in FIG. 9, a delay circuit 40 retards the fall of the $IG_t$ signal by the time length $\tau_1$ (say, 40 μs) to produce an output $V_{41}$, in such a manner that $\tau_1 > \tau_2$ where $\tau_2$ is the time length (say, 30 μs) required for the voltage $V_{CO}$ of the capacitor 13 to discharge and drop to 0 level. The time $\tau_2$ for which the capacitor voltage $V_{CO}$ drops from a charged state to 0 level with the conduction of the MOSFET 11*a* at the fall of the $IG_t$ signal varies with the capacitance of the capacitor and the primary coil inductance and temperature. It is therefore desirable to set a time lag $\tau_3$ (say, 20 μs) between the off timing of the power transistor 6 and the on timing of the MOSFET 11*a* to the relationship $0 < \tau_3 < \tau_2$. This requirement cannot be met if the value $\tau_3$ is set to a fixed time. Thus the capacitor voltage $V_{CO}$ is detected as shown in FIG. 9, $\tau_3$ is determined at a predetermined threshold voltage $V_{74}$, the transistor 87 is turned on by a rise pulse of the output $V_{85}$ of the comparator 85 through the comparator 75, and the base current of the power transistor 6 is thus cut off thereby to determine the off timing of the power transistor 6. The off timing of the MOSFET 11*a* coincides with the time when the primary current $i_1$ reaches a predetermined voltage $V_{ref}$, and the capacitor 13 is completely charged at a time $\tau_5$ (say, 100 μs). In the process, the simultaneous occurrences of currents flowing in the power transistor 6 and the MOSFET 11*a* are prevented by preventing the power transistor 6 from being turned on until the capacitor 13 is completely charged by the capacitor voltage $V_{CO}$. Specifically, the transistor 87 is turned on to bypass the base current of the power transistor 6 until a time point lagging a predetermined time $\tau_4$ (say, 120 μs) from a time point delayed $\tau_6$ (say, 20 μs) from the charging start point of the capacitor 13 when the capacitor voltage $V_{CO}$ is compared with a predetermined threshold voltage $V_{74}$ and detected at the comparator 75. In this way, the capacitor voltage $V_{CO}$ is detected by using the predetermined threshold voltage $V_{74}$ to obtain a pulse output $V_{75}$, and further during a pulse $V_{85}$ generated with a predetermined time lag from fall of pulse output $V_{75}$ through the capacitor 78 and the comparator 85, the power transistor 6 is turned off, so that the on timing of the MOSFET 11*a* is advanced a predetermined time $\tau_3$ from the off timing of the power transistor 6 thereby to increase the primary coil current $i_1$. In this manner, the current flowing time of the energy storage coil 3 for charging the capacitor 13 is shortened on one hand, and the power transistor 6 is prevented from turning on before the full rise-up of the capacitor voltage $V_{CO}$ by charging of the capacitor on the other.

In the above-mentioned fifth embodiment, the engine speed detection circuit 90 is used to switch the arc time point above a predetermined engine speed. As an alternative method, the arc timing may be selected by the value stored in memory for forming a map in accordance with the engine speed, the negative pressure of the intake manifold or the like engine parameter.

Also, the fifth embodiment described above is such that the arc timing is controlled by a short pulse output $V_{92}$ of the monostable circuit 8*a* when the engine speed is higher than a predetermined value. Instead, without using the pulse output of the monostable circuit 8*a*, the arc timing may be controlled in such a manner that the MOSFET 11*a* is turned off when the output of the comparator 17 falls to low level with the decrease of the primary coil current $i_1$ below a predetermined level (time point $t_5$ in FIG. 8). By doing so, the charge voltage of the capacitor 13 can be kept constant under high engine speeds.

Figure 11:
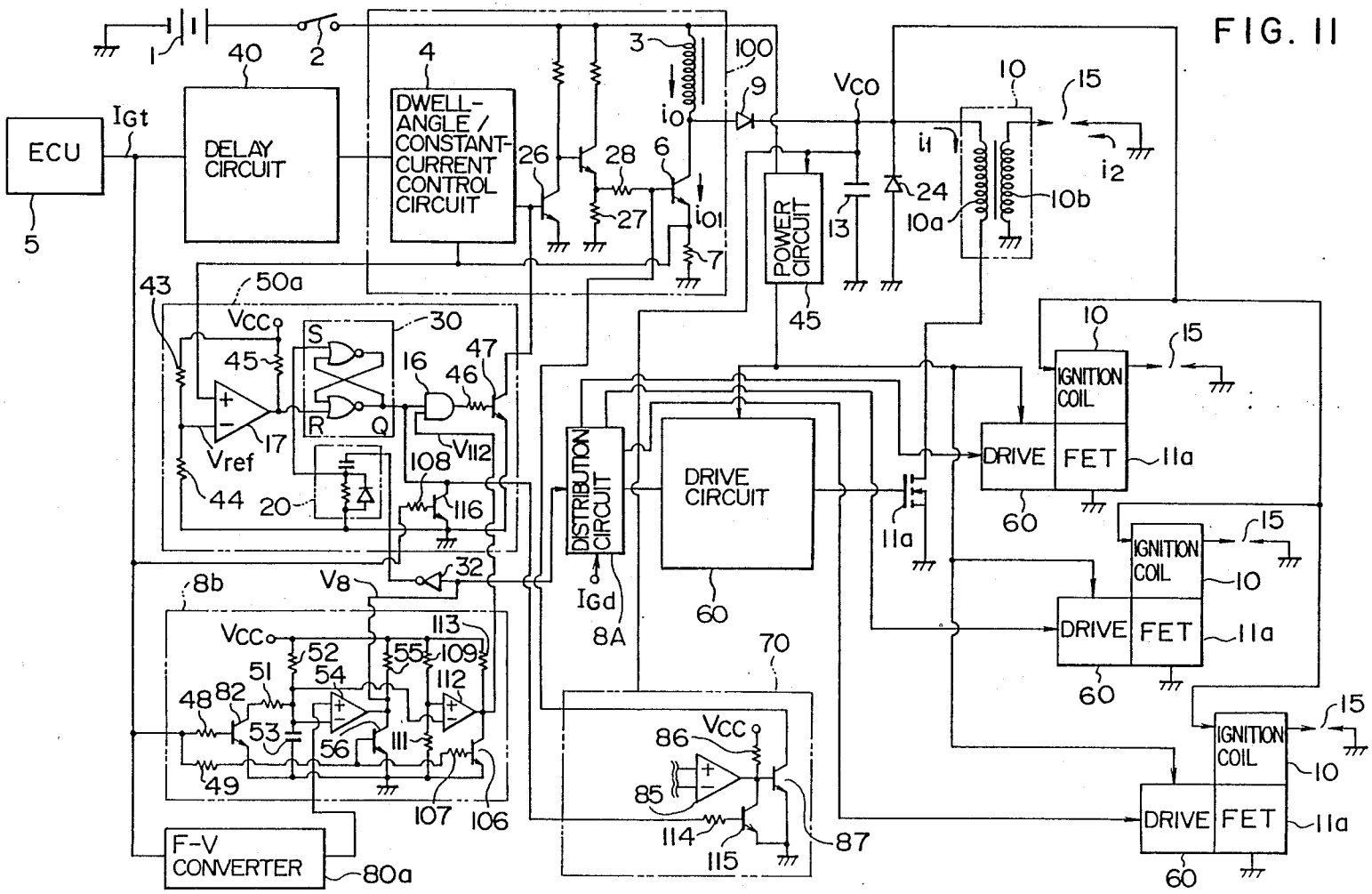
Figure 12:
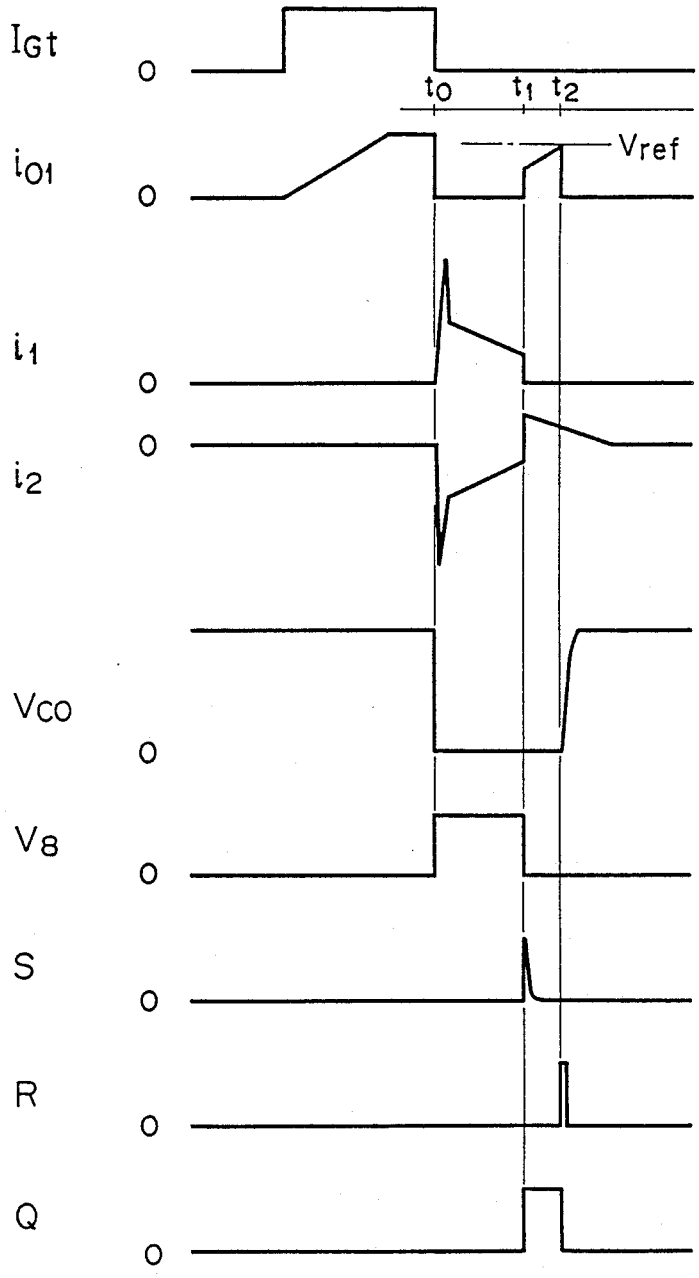
FIG. 12 shows waveforms produced at various parts for explaining the operation of the system shown in FIG. 11.

FIG. 11 shows a sixth embodiment of the present invention, and FIG. 12 waveforms produced at various parts for explaining the operation of the system shown in FIG. 11. In the sixth embodiment, the following points are different from the fifth embodiment:

(a) The capacitor 13 is connected with a parallel circuit including the primary winding 10*a* of the ignition coil 10 and the MOSFET 11*a*.

(b) The diode 24 is connected in parallel to the capacitor 13 with the anode of the diode 24 grounded, while the diodes 12 and 14 are eliminated.

(c) The constant-current control circuit 50 is replaced by a capacitor charging control circuit 50*a* for controlling the power transistor 6.

(d) The monostable circuit 8*a* for generating three monostable outputs is replaced with a monostable circuit 8*a* for generating two monostable outputs $V_8$ and $V_{112}$, and an output $V_8$ of the monostable circuit 8*b* is directly connected to the distribution circuit 8A, while the arc time switching circuit 110 is eliminated.

(e) Of all the component parts of the engine speed detection circuit 90, only the F-V converter 80a (the output voltage of which decreases in proportion to the rise in engine speed) is used, and the output of the F-V converter 80a is connected to the positive input terminal of the comparator 54 of the monostable circuit 8b.

(f) The base-emitter circuit of the transistor 87 of the capacitor voltage detection delay/simultaneous-current-flow preventing circuit 70 is connected in parallel to the collector-emitter circuit of the transistor 115, the base of which is connected through the resistor 114 to the output terminal Q of the flip-flop of the capacitor charge control circuit 50a.

Now, the configuration of the capacitor charge control circuit 50a will be explained in detail. The output of the comparator 17 is connected to the R terminal of the flip-flop 30, and an output $V_8$ of the monostable circuit 8b to the input terminal of the differentiation circuit 20 through the inverter 32. The output terminal Q of the flip-flop 30 is connected to an input of the AND gate 16, the output of which is connected through a resistor 46 to the base of a transistor 47, the emitter and collector of which are in turn connected to the earth and to the base of the transistor 26 in the energy storage circuit 100 respectively. The other input of the AND gate 16 is connected to the other output $V_{112}$ of the monostable circuit 8b. The output Q of the flip-flop 30 is connected to the collector of the transistor 116, the emitter and the base of which are grounded and connected to the $I_{Gt}$ signal through a resistor 108 respectively.

Now, the operation of the sixth embodiment having the above-mentioned configuration will be explained with reference to FIG. 12. The $I_{Gt}$ signal turns on the power transistor 6, and energy is stored in the energy storage coil 3, and when the $I_{Gt}$ signal is reduced to low level at a time point $t_0$ making up an ignition timing, the power transistor 6 is turned off. At substantially the same time, the output $V_8$ of the monostable circuit 8b is generated thereby to turn on a MOSFET 11a associated with the pulse time ($t_0$ to $t_1$ in FIG. 12) and ignition timing represented by this output $V_8$. As a result, a current combining the energy in the capacitor 13 with that in the energy storage coil 3 flows as the primary current, the pulse time of which corresponds to the main arc time for the ignition plug 15 and shortens progressively with the increase in engine speed in response to the output of the F-V converter 80a.

When the output $V_8$ of the monostable circuit 8 drops to low level at the time point $t_1$ in FIG. 12, the flip-flop 30 is set through the inverter 32 and the differentiation circuit 20, so that the transistor 47 begins to conduct. The base current of the transistor 26 in the energy storage coil 100 is thus bypassed thereby to again turn on the power transistor 6, thus storing energy again in the energy storage coil 3. At the time point $t_2$ when the current $i_{01}$ flowing in the energy storage coil 3 reaches a predetermined value as shown in FIG. 12, a high-level signal is generated at the comparator 17 to reset the flip-flop 30, while turning off the power transistor 6. As a consequence, the capacitor 13 is charged to a predetermined voltage as shown by $V_{CO}$ in FIG. 12 by the energy stored in the energy storage coil 3, and thus the charge voltage of the capacitor 13 is used for the next ignition cycle.

When the MOSFET 11a turns off at the time point $t_1$ in FIG. 12, on the other hand, the energy stored in the ignition coil 10 is discharged (with polarity reversed) from the positive terminal, i.e., secondary winding 10b to the ignition plug 15, thus extending the arc time accordingly.

In the process, with a resistor 114 and a transistor 115 added to the capacitor voltage detection delay/simultaneous-current-flow preventing circuit 70, the operation of the circuit 70 is prohibited as long as the pulse duration of the output Q of the flip-flop 30. As a result, even when the capacitor 13 is not charged, the power transistor 6 is capable of being again turned on for the pulse duration of the output Q of the flip-flop 30. Also, during the high level of the $I_{Gt}$ signal, the transistor 107 conducts to bypass the output Q of the flip-flop 30, so that the output Q of the flip-flop 30 is reduced to low level in priority while the $I_{Gt}$ signal is at high level. By doing so, if the $I_{Gt}$ signal for the next ignition cycle rises before the current $i_{01}$ reaches a predetermined value during the high engine speed, the transistor 47 is turned off forcibly. As the result of the output Q of the flip-flop 30 becoming low in level, on the other hand, the transistor 115 also turns off, so that the operation of the capacitor voltage detection delay/simultaneous current-flow preventing circuit 70 becomes effective. The power transistor 6 is turned off until the capacitor 13 is fully charged, and after that, the power transistor 6 is turned on by the $I_{Gt}$ signal.

In the embodiment of FIG. 11, the diode 24 serves to the operation that in the case where the charges in the capacitor 13 are discharged through the MOSFET 11a, even after the charges in the capacitor 13 are completely discharged, a current continues to flow in the primary winding 10athrough the MOSFET 11a and the diode 24 by the electromotive force induced in the primary winding 10a, thus extending the arc time in the ignition plug 15. The arc time could also be extended by connecting the anode of the diode 24 to the connection point of the primary winding 10a and the MOSFET 11a instead of grounding it. In that case, however, at the time point $t_1$ in FIG. 12 when the MOSFET 11a is turned off, the energy stored in the primary winding 10a would be discharged uselessly through the diode 24 (as the result of the secondary output with such a polarity to cancel the secondary discharge current generated between time points $t_1$ and $t_2$ in FIG. 12), thereby undesirably heating the ignition coil.

In the embodiment of FIG. 11 in which the power transistor 6 is turned on simultaneously with the turning off of the MOSFET 11a, the use of a thyristor in place of the MOSFET 11a as the second switching device makes it possible to turn off the thyristor automatically since the source voltage is not applied to the thyristor because of the turning on of the power transistor 6 (with the holding current interrupted). If a thyristor is used in this way, therefore, a short trigger pulse may be generated at the thyristor gate to turn it on at the time point $t_0$ in FIG. 12. It is also possible to use a transformer with the primary and secondary windings in place of a single-winding coil as the energy storage coil 3.

Figure 13:
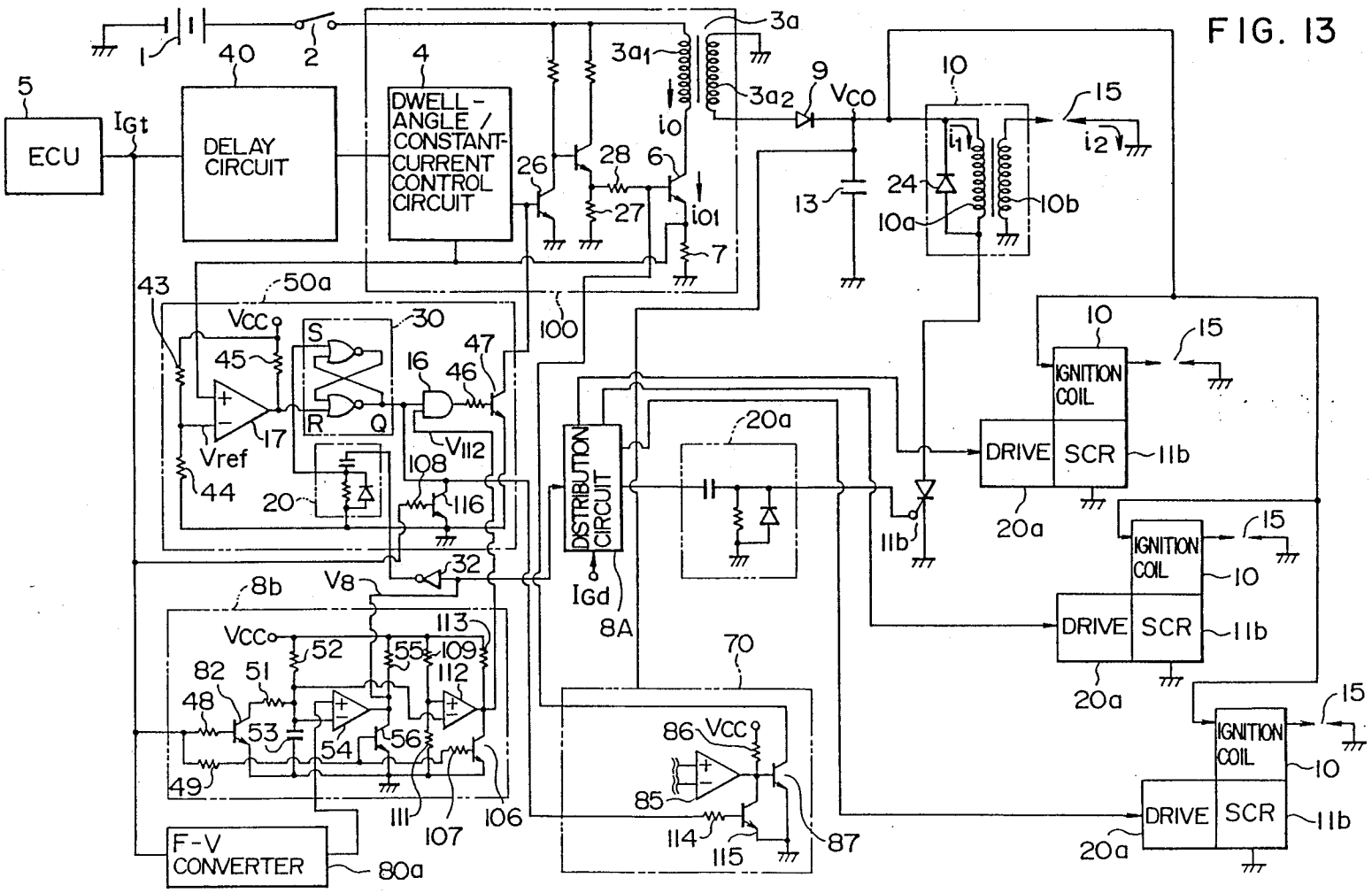
FIG. 13 is a diagram showing an electrical circuit according to a seventh embodiment of the present invention.
Figure 14:
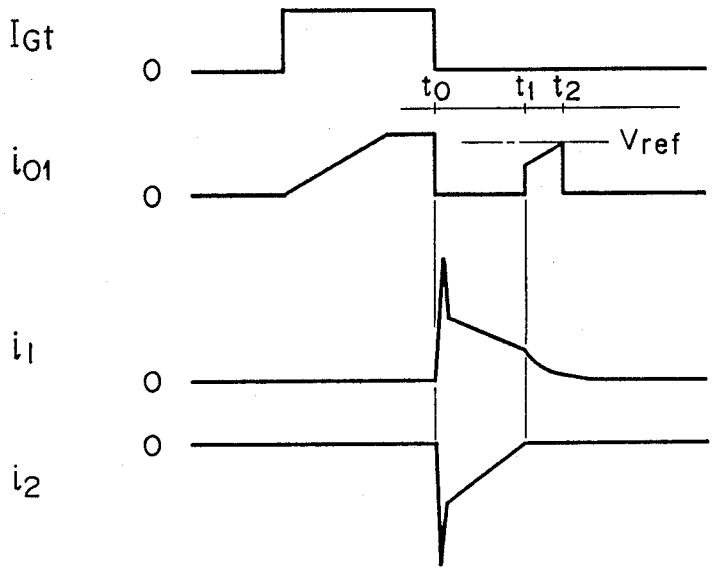
FIG. 14 shows waveforms produced at various parts of the system shown in FIG. 13.

A system using the above-mentioned configuration is shown as a seventh embodiment in FIG. 13. In FIG. 13, numeral 3 designates a transformer having a primary winding 3a1 and a secondary winding 3a2 with substantially the same number of turns, making up an energy storage coil. The primary winding 3a1 is connected between a key switch 2 and the collector of a power transistor 6, and an end of the secondary winding 3a2 is grounded, the other end thereof being to the anode of the diode 9. Numeral 11*b* designates a thyristor inserted for each cylinder in place of the MOSFET 11*a*, and numeral 20*a* a differentiation circuit replacing the drive circuit 60 connected between the distribution circuit 8A and the gate of each thyristor 11*b*. The diode 24 is connected in parallel to the primary winding 10*a* of each ignition coil 10 and built in the ignition coil 10. The waveforms produced at various parts of the circuit shown in FIG. 13 including the ignition signal $I_{Gt}$, the current $i_{01}$ flowing in the detection resistor 7, the primary current $i_1$ of the ignition coil 10 and the secondary discharge current $I_2$ of the ignition coil 10 are shown in FIG. 14.

In the aforementioned embodiments, the diode 9 is used to prevent the charges in the capacitor 13 from being discharged toward the energy storage coils 3, 3*a*. In place of such a diode 9, a switching device adapted to turn only when necessary may be inserted.

Further, in each embodiment described above, the capacitor 13 is charged by the energy stored in the energy storage coils 3, 3*a*. The coils 3, 3*a*, however, may be replaced by a DC-DC converter for charging the capacitor 13 with high voltage.

It will thus be understood from the foregoing description that according to the present invention, a capacitor may be charged by the energy stored in an energy storage coil, and the primary winding of the ignition coil is supplied with the energy charged in the capacitor and stored in the energy storage coil to eliminate the need of a specific DC-DC converter for charging the capacitor with high voltage. As a consequence, the only function of the ignition coil is to operate as a transformer basically, and is not required to store a large magnetic energy, thus making it possible to reduce the size thereof. An ignition system is thus provided which is comparatively compact and simple in configuration, rapid in the rise of a spark discharge current with a long discharge time for an improved ignition performance.

Further, while the second switching device is turned off, the capacitor is charged by the energy stored in advance in the energy storage coil through the primary winding of the ignition coil and a second diode, so that the first switching device may be interrupted only once for each ignition cycle. In addition, even when the second switching device is turned off, the primary current of the ignition coil returns through the first and second diodes, with the result that the primary current is prevented from being turned off abruptly, thereby preventing a wasteful high voltage from being generated in the secondary winding of the ignition coil when the second switching device is turned off.

We claim:

1. An ignition system for an internal combustion engine, comprising:

a first series closed-loop circuit including a series connection of a DC power supply, an energy storage coil coupled to the DC power supply, and a first switching device coupled to the energy storage coil;

a second series closed-loop circuit coupled to the energy storage coil, including a series connection of a first diode, the primary winding of an ignition coil coupled to the diode, and a second switching device coupled to the primary winding;

a capacitor, connected to the energy storage coil through the diode; and switching device control means for:

(1) first turning on a selected one of the first and second switching devices to store energy in the energy storage coil, (2) subsequently turning off the selected one switching device to charge the capacitor using the energy stored in the energy storage coil, (3) turning on the first switching device, after the charging the capacitor step, to store energy in the energy coil from the DC power supply, (4) subsequently turning on the second switching device at substantially at the same time as a time of turning off of the first switching device and at an ignition timing, thereby to supply the primary winding of the ignition coil with both the energy stored in the energy storage coil and the energy charged in the capacitor.

2. An ignition system according to claim 1, wherein said ignition coil is a closed magnetic loop coil in which an air gap is intentionally eliminated from the closed magnetic loop.

3. An ignition system according to claim 1, wherein a single energy storage coil, a single first switching device and a single capacitor are shared by a plurality of cylinders, and each of the ignition coils and each of the second switching devices correspond to each of the cylinders.

4. An ignition system according to claim 1, wherein said switching control means includes first control signal generation means for turning on the first switching device a predetermined time before an ignition timing and generating a first control signal for turning off the first switching device at the ignition timing, second control signal generation means for turning on the second switching device from an ignition timing and generating a second control signal for turning off the second switching device a predetermined time after the ignition timing, and third control signal generation means for turning on the first switching device again substantially simultaneously with the turning off of the second switching device and generating a third control signal for turning off the first switching device a predetermined thereafter.

5. An ignition system according to claim 4, wherein said first control signal generation means includes constant-current control means for detecting the current flowing in the first switching device and limiting the current in the first switching device when the current exceeds a predetermined value and a sufficient magnetic energy is stored in the energy storage coil.

6. An ignition system according to claim 4, wherein the time width of the second control signal generated in said second control signal generation means varies in accordance with the engine speed.

7. An ignition system according to claim 4, wherein said third control signal generation means includes means for detecting the current flowing in the first switching device and extinguishing the third control signal when the current flowing in the first switching device exceeds a predetermined value and a sufficient magnetic energy is stored in the energy storage coil.

8. An ignition system according to claim 4, wherein said third control signal generation means includes means for extinguishing the third control signal forcibly when the first control signal for the next ignition cycle is generated in the first control signal generation means at the time of generation of the third control signal from the third control signal generation means.

9. An ignition system according to claim 4, wherein said capacitor is connected in parallel to a series circuit including the primary winding of the ignition coil and the second switching device.

10. An ignition system according to claim 4, further comprising a second diode connected across the primary winding of the ignition coil through the second switching device for extending a time of an ignition arc.

11. An ignition system according to claim 1, wherein the time of turning on the second switching device is slightly advanced from the time of turning off the first switching device at an ignition timing by the switching device control means.

12. An ignition system according to claim 4, wherein the switching device control means includes means for preventing the generation of the first control signal until the charge voltage of the capacitor exceeds a predetermined value.

13. An ignition system according to claim 1, wherein the second switching device includes a field effect transistor and the switching device control means includes a power circuit for supplying a gate voltage to the field effect transistor with the charges in the capacitor as a power supply.

14. An ignition system for an internal combustion engine comprising:

a first series closed circuit including a series connection of a DC power supply, an energy storage coil and a first switching device;

a second series closed circuit coupled to the energy storage coil, including a series connection of a first diode, a primary winding of an ignition coil and a second switching device;

a series circuit including a series connection of a second diode and a capacitor in parallel to the second switching device;

a third series closed circuit coupled to the primary winding of the ignition coil the second switching device, and the capacitor and including a third diode in series therewith; and switching device control means for charging the capacitor from the first series circuit including the energy storage coil and the primary winding of the ignition coil at a time of turning off of the second switching device, for turning on the first switching device to store energy in the energy storage coil from the DC power supply after charging of the capacitor, and for turning on the second switching device substantially at the same time as the first switching device at a subsequent ignition timing, thereby supplying the primary winding of the ignition coil with the energy stored in both the energy storage coil and the energy charged in the capacitor.

15. An ignition system according to claim 14, wherein a single energy storage coil, a single first switching device and a single capacitor are shared by a plurality of cylinders, and a plurality of ignition coils, a plurality of first switching devices and a plurality of second switching devices correspond to a plurality of second diodes and a plurality of cylinders respectively.

16. An ignition system according to claim 14, wherein said switching device control means includes first control signal generation means for generating a first control signal for turning off the first switching device at an ignition timing after energization of the first switching device a predetermined time before the ignition timing, and second control signal generation means for generating a second control signal for turning off the second switching device a predetermined time after the turning on of the second switching device from an ignition timing.

17. An ignition system according to claim 16, wherein said second control signal generation means includes monostable means for generating a monostable output of a predetermined time width.

18. An ignition system according to claim 16, wherein said second control signal generation means includes turnoff control means for detecting the current flowing in the second switching device and turning off the second switching device when the current flowing in the second switching device exceeds a predetermined value and a sufficient magnetic energy is stored in the energy storage coil.

19. An ignition system according to claim 18, wherein said second control signal generation means includes means for substantially invalidating the operation of the turn-off control means during the period from the turning on of the second switching device while a current more than a predetermined value is flowing in the primary winding of the ignition coil by the energy stored in the energy storage coil and the energy charged in the capacitor.

20. An ignition system according to claim 19, wherein said second control signal generation means includes means for turning off the second switching device in the case where the current flowing in the second switching device fails to reach a predetermined value after the lapse of a predetermined time from the turning on of the second switching device.

21. An ignition system according to claim 18, wherein said second control signal generation means includes means for turning off the second switching device while a sufficient energy remains in the energy storage coil when the energy charged in the capacitor is supplied to the primary winding of the ignition coil after the turning on of the second switching device with the engine speed exceeding a predetermined level.

22. An ignition system according to claim 7, wherein said third control signal generation means includes means extinguishing the third control signal when the current flowing in the first switching device fails to reach a predetermined value after the lapse of a predetermined time from the turning on of the first switching device.

23. An ignition system according to claim 16, wherein said switching device control means includes means for preventing the generation of the first control signal before the voltage across the capacitor exceeds a predetermined value.

24. A high-energy ignition system comprising:

an ignition coil for generating a high ignition voltage across its second winding when a current is supplied to a primary winding thereof, a capacitor, means for charging the capacitor, an energy storage coil, energy storage means for supplying a current to the energy storage coil to store energy therein, and energy supply means for supplying a single primary winding of the ignition coil at a predetermined timing with both the energy stored in the energy storage coil and the energy charged in the capacitor.

25. A high-energy ignition system comprising:

an ignition coil for generating a high ignition voltage in its secondary when a current is supplied to its primary, a capacitor, an energy storage coil, energy storage means for periodically supplying the energy storage coil with a current, capacitor charging means for supplying and charging the capacitor with the energy stored in the energy storage coil at a first timing, and energy supply means for supplying the primary of the ignition coil with both the energy stored in the energy storage coil and the energy charged in the capacitor at a second timing retarded from the first timing.

* * * * *